US008801369B2

(12) United States Patent
Gaia et al.

(10) Patent No.: US 8,801,369 B2
(45) Date of Patent: Aug. 12, 2014

(54) TURBINE FOR THE EXPANSION OF GAS/VAPOUR

(75) Inventors: Mario Gaia, Brescia (IT); Roberto Bini, Brescia (IT)

(73) Assignee: Turboden S.r.l., Brescia (IT)

( * ) Notice: Subject to any disclaimer, the term of this patent is extended or adjusted under 35 U.S.C. 154(b) by 499 days.

(21) Appl. No.: 13/257,097

(22) PCT Filed: Mar. 16, 2010

(86) PCT No.: PCT/IT2010/000112

§ 371 (c)(1),
(2), (4) Date: Sep. 20, 2011

(87) PCT Pub. No.: WO2010/106569

PCT Pub. Date: Sep. 23, 2010

(65) Prior Publication Data

US 2012/0009061 A1 Jan. 12, 2012

(30) Foreign Application Priority Data

Mar. 18, 2009 (IT) ..... BS2009A0051

(51) Int. Cl.
*F01D 25/24* (2006.01)

(52) U.S. Cl.
USPC ..... 415/131

(58) Field of Classification Search
CPC ..... F01D 25/16; F01D 25/162; F04D 29/05; F04D 29/051; F04D 29/052; F04D 29/056; F04D 29/0563
USPC ..... 415/129, 131, 132, 140
See application file for complete search history.

(56) References Cited

U.S. PATENT DOCUMENTS

| | | | | |
|---|---|---|---|---|
| 3,711,218 | A * | 1/1973 | Kennel et al. | 415/131 |
| 4,268,229 | A * | 5/1981 | Berg | 417/407 |
| 4,389,052 | A * | 6/1983 | Shimizu et al. | 277/346 |
| 4,439,096 | A * | 3/1984 | Rockwood et al. | 415/131 |
| 4,575,306 | A * | 3/1986 | Monnot | 415/131 |
| 4,997,191 | A * | 3/1991 | Warner | 277/377 |
| 5,540,192 | A * | 7/1996 | Xanders | 123/41.44 |
| 6,375,414 | B1 * | 4/2002 | Delaney | 415/111 |
| 6,893,213 | B1 * | 5/2005 | Quill et al. | 415/131 |
| 7,168,915 | B2 * | 1/2007 | Doering et al. | 415/121.1 |
| 2004/0200215 | A1 | 10/2004 | Woollenweber et al. | |
| 2007/0258669 | A1 | 11/2007 | Lee | |

FOREIGN PATENT DOCUMENTS

EP 1 566 530 A 8/2005

* cited by examiner

*Primary Examiner* — Nathaniel Wiehe
*Assistant Examiner* — Eldon Brockman
(74) *Attorney, Agent, or Firm* — McGlew and Tuttle, P.C.

(57) ABSTRACT

The invention regards a turbine for the expansion of gas and vapor that comprises a body or casing with a volute for the transit of the fluid from an input to an output passage through at least a statoric and a rotoric group, a possible front shield that extends radially from said volute towards the axis of the turbine shaft, an external tube member fixed in front of said shield or said volute designed to hold the turbine shaft with the interposition of a supporting unit (19), where said turbine shaft (15) has a head (15') supporting the rotoric group (16, 17). The turbine shaft (15) together with the rotoric group (16, 17) is movable axially between a work position, in which the head of said shaft is at a distance from an internal end of the external tube member (18) facing towards the statoric group, and a retracted position, in which the head of the shaft or a part of the rotoric group rests against said internal end of said tube member with the interposition of at least a front seal (41).

12 Claims, 3 Drawing Sheets

TURBINE FOR THE EXPANSION OF GAS/VAPOUR

FIELD OF THE INVENTION

This invention refers to the turbine sector for the expansion in particular of gas and vapour with high molecular mass, and concerns chiefly the improvements of the general structure of a one or more stage turbine.

STATE OF THE TECHNIQUE

The turbine for the expansion of gas and vapour of the type taken into consideration basically comprise a fixed body or casing with an entrance and an exit passage of the work fluid, at least a first stator and possible following turbine stages, a turbine shaft rotating around an axis and supporting at least a first rotor and possible other rotors respectively associated with the first stator and following stators, and a system for the assembly and support of said turbine shaft on the body or casing.

It is well known that in order to obtain high efficiency, the play between the fixed part, that is the body or casing, and the rotating part, that is to say every runner of the turbine, must be reduced in correspondence with certain points where the blow-by of fluid can become an important leakage factor: in particular in the labyrinth seals and in the space between the peak of the blades and the fixed ring skimmed by the blades themselves.

The maintenance of small play is made possible by the fact that also the mechanical stress in the rotating parts are moderate, so there is a moderate variation in their dimensions, in particular the diameters, during the starting transient and the normal operation of the machine.

As regards to the above the use of roller bearings is often preferable for the support of the shaft of the turbine: in fact the roller bearings can be made without intrinsic play, so that the radial position of the shaft when the machine is either idle or in rotation, coincide. Furthermore the roller bearings are less expensive than the piston bearings, and are withstand a brief lack of lubrication, which on the other hand would rapidly damage the piston bearings. Furthermore roller bearings are not damaged by frequent starting and stopping, on the contrary to the piston bearings.

In any case, whether there are roller bearings or piston bearings, it is important for the change of bearings to be easy and rapid, the same applying to the change of the rotating seals (whether, as is known, they are, flat faced mechanical seals, gas seals, labyrinth seals or of another type) that block the passage of the work fluid from the internal volume of the turbine to the atmosphere and vice versa, should the internal pressure of the work fluid be lower than the atmospheric pressure, preventing the entrance of air in the internal volume of the expander.

It is also important that when the turbine is in order its rotoric group remains slightly at a distance from the axial system of the support of the turbine shaft and more in particular of the internal end of the stationary part of the system represented by a tube member in which extends the turbine shaft.

But it is also important to be able to isolate the inside of the body or casing of the turbine from the outside when the supporting system of the shaft has to be dismantled for any type of maintenance and/or replacement of bearings or seals. This, obviously, to prevent dispersion of fluid from inside the body or casing to the outside on a level with the turbine shaft.

This invention was conceived on the basis of the considerations referred to above placing particular attention to the axial positioning of the rotoric group of the turbine during the use and confinement of the internal fluid of the body or casing of the turbine during all maintenance of the supporting system of the turbine shaft.

Consequently, this invention proposes a turbine structure for expansion of gas or vapour that comprises a body or casing with a transit volute of the work fluid from an entrance passage to an exit passage through stators and rotors, a possible frontal shield extending radially from said volute towards the axis of the turbine shaft, an external tube member fixed to the front of said shield and designed to support the turbine shaft with the interposition of a support unit, and where said shaft motor has at least a head carrying a rotoric group operating in said body or casing, characterized in that the turbine shaft together with the rotoric group is moveable axially between a work position, in which the head of said shaft is distanced from the internal end of the tube member, and a retracted position in which the head of the turbine or a part of the rotoric group rests against said internal end of said tube member with the interposition of at least a frontal sealing.

In this way, when the turbine shaft is in the retracted position it will be possible to dismantle and/or maintain the supporting system of the turbine shaft, keeping confined, without dispersion, the internal fluid of the body or casing. For the movements of the turbine shaft and with it the rotoric group from one position to the other, positioning means are provided at least between one frontal wall of the body or casing of the turbine and the rotoric group that is the head of said shaft.

The supporting unit of the turbine shaft is, preferably, extractable axially in block from the external tube member excluding the shaft, said supporting unit basically comprising an internal concentric coupling to the turbine shaft carrying inside it some bearings and some sealing means operating on said shaft. In this case, and advantageously, when the turbine shaft is moved back to confine the internal fluid inside the body or casing also an axial movement can be carried out of the supporting unit to facilitate in this way the extraction of the tube member.

BRIEF DESCRIPTION OF THE DRAWINGS

The invention will however be described in the following in more detail with reference to the schematic drawings enclosed, in which.

DETAILED DESCRIPTION OF THE INVENTION

Figure 1:
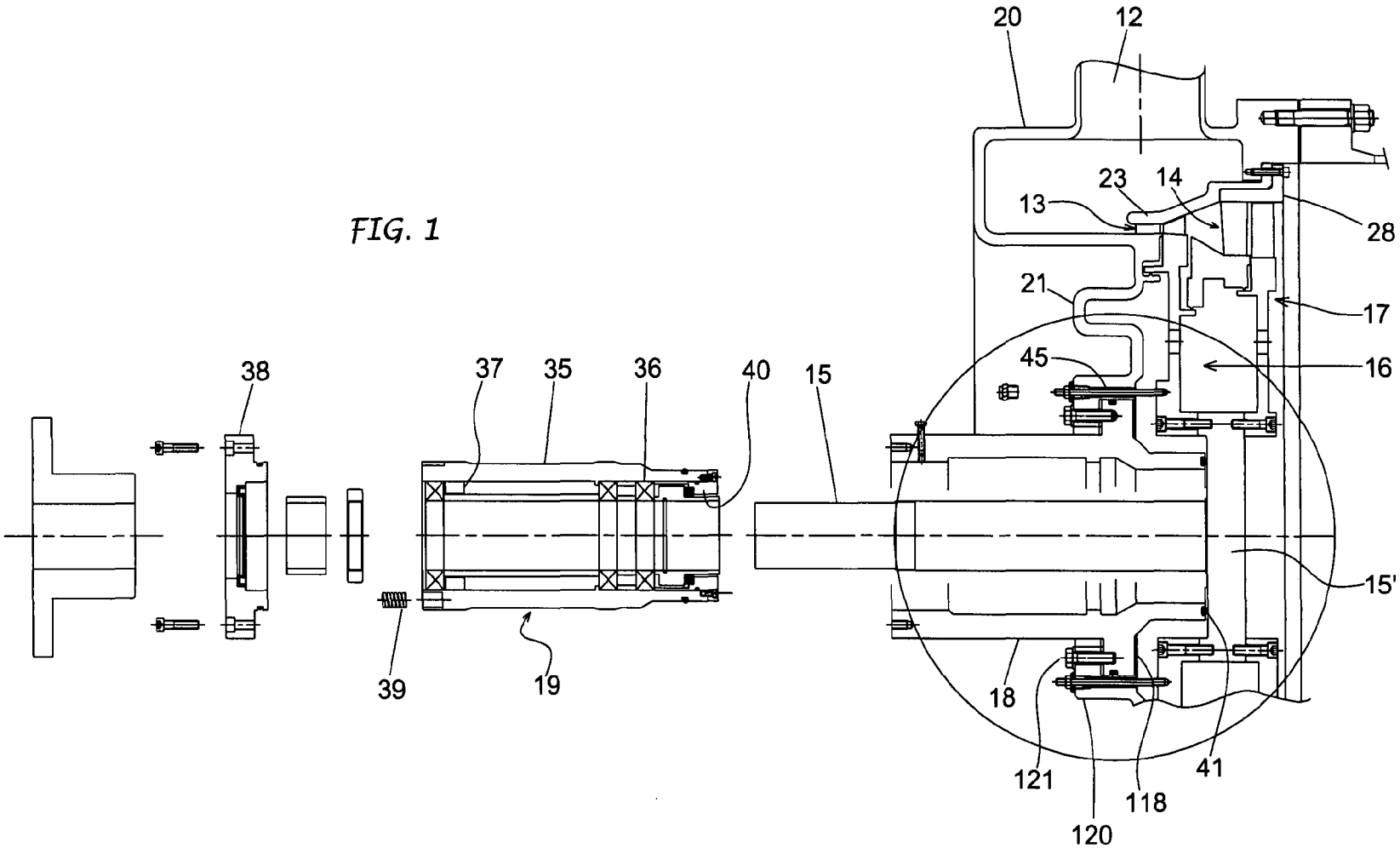
FIG. 1 shows, in a cross sectional view, a part of a dual stage turbine with some separate components.

The description that follows refers to an axial turbine, that is to say a turbine in which the mass transport from the input to the output of the dynamic fluid passage in which the expansion takes place is predominantly due to the axial component of the speed of the fluid, but the invention is also applicable to the turbine with diagonal flow or also only locally radial.

In the example shown the turbine, although only partially illustrated, is the axial type and comprises two stages. It basically has: a body or casing 11 having an entrance passage of the fluid 12 and an exit passage—not shown—; a first stator 13 and a second stator 14 respectively of a first and a s second stage of the turbine; a turbine shaft 15 rotating around an axis X and carrying a first rotor 16 and a second rotor 17 respectively associated with the first stator 13 and the second stator 14; and a system for the assembling of said shaft on the body or casing 11 made up of a tube member 18 and by a supporting unit 19 inside the tube member.

Starting from its most external part, the body or casing of the turbine 11 is made up of a volute 20 and a possible frontal annular shield 21. The volute 20 acts as a pipe through which the fluid, which arrives from the entrance passage 12, is carried by the stator 13 of the first stage and in succession to the second stage or following stages.

The annular shield 21, when present, extends radially from the volute 20 towards the X axis of the shaft 15. The volute 20 and the shield 21 can be in an integral piece, as shown in the drawings, or made up of two respective pieces fixed between them by welding or by a flanged coupling. Preferably the shield 21 is not flat but, seen in meridian cross-section, has an undulating shape, defined by a succession of cylindrical or also conical parts joined by radial sections, defining loops or protrusions.

This configuration is such to allow deformations of the shield 21 faced to absorb the radial dilations and to limit the stress due to the differences in temperature between the inside and outside of the turbine so as not to affect the coaxiality of the system.

The stator 13 of the first stage of the turbine is made up of a respective first plurality of statoric blades 22 fixed towards the outside of a first primo statoric ring 23. This ring is fixed overhanging inside the volute, or to a flange connected to it, so that the ends of said blades 22 rest against the internal surface 24 of a part of the volute 20 just upstream of the rotor 16 of the first stage, directly, or by means of an interposed calibrated ring—non shown—which should be returned to the internal surface of the volute and the making of which would then be more simple.

The first rotor 16 is made up of a relative disc 25 fixed to the turbine shaft 15 and carrying radial blades 26 facing towards and skimming said statoric ring 23 with reduced play and/or with the possible interposition of a peripheral ring, continuous or segmented, attached to the blades.

Likewise, the stator 14 of the second stage of the turbine is made up of a relative second plurality of statoric blades 27 supported, externally, by a second statoric ring 28 that is fixed like the first statoric ring 23, or as one, inside the volute 20, so that the ends of said second blades 27 rest against an interstage diaphragm 29 just upstream of the second rotor 17. Also this second rotor is made up of a relative disc 30 fixed to the turbine shaft 15 in the same way as to the disc 25 of the first rotor 16 and is equipped with radial blades 31 facing towards and skimming said second statoric ring 28.

The interstage diaphragm 29 is static, positioned between the discs 25, 30 of the two rotors 16, 17 with the interposition of cusp shaped labyrinth seals 32.

As a whole, the support of the statoric blades, in particular those of the first statoric ring that are less radially extended, to the internal surface of the volute directly or indirectly, ensures the concentricity between the rotation axis of the rotors 16, 17, coincident obviously with the axis X of the turbine shaft 15, and the external statoric rings 23, 28 during the functioning of the turbine, a condition that would not exist if the coaxiality depended on only the internal side of the volute, larger and connected to the tube member with a longer route and thus subject to greater expansion due to heat and diameter variations.

The turbine shaft 15 has a preset diameter, and at its end facing towards the inside of the turbine it can have at least a head 15' made preferably in an integral form with the shaft—FIG. 1—. As shown, discs 25, 30 of the rotors 16, 17 are fixed on opposite parts of the head 15' of the shaft 15, for example both by means of a toothed system and/or with screwed tie rod or the like 33.

The tube member 18 of the assembly system of the turbine shaft 15 is connected coaxially to the shield 21 and protrudes from the front of the casing 11 according to the axis X of said shaft. The connection can be carried out by welding or by means of flanging. In the second case, the tube member 18 has s a peripheral flange 118 that is fixed by screws 121, to a counterflange 120 provided along the internal margin of the shield 21, and between flange and counterflange are placed some spacers 34. These spacers are made preferably of washers that can be different in width or be placed one on top of the other in different quantities so as to establish a correct connection and radial play between the ends of the rotoric blades and the corresponding statoric ring of the first stage.

In addition, the tube member 18 and the turbine casing 11 or, better, the front of the volute 20, can be connected by a support 122, for example of the cross journal or dial type, designed to prevent axial deviations, vibrations or oscillations of the tube member itself and to maintain the concentricity between the volute and the rotating parts of the turbine.

The support unit 19 of the turbine shaft 15 is made up of components that are assembled when fitted in the tube member around the shaft and which are then, preferably, extractable altogether axially from the tube member 18 except for the shaft 15.

In particular, the supporting unit 19 comprises a coupling 35 concentric to the turbine shaft 15, that has an external diameter compatible with the internal diameter of the tube member 18 and which has internally, with the help of spacers, some bearings 36 and a sealing system 40 operating on the shaft.

It is important for the radial connection of the supporting unit with the tube member 18 to be made so as not to cause deformations of the internal coupling 35 nor variations in its coaxiality with regards to the turbine shaft. This aim can be reached, advantageously, by a connection of the is ostatic type between the external tube member 18, realized through two circumferential limit supporting zones in a direction that is longitudinal between the internal surfaces of the tube member 18 and external of the coupling 35.

The supporting unit 19 is held axially in the tube member 18 by means of a ring nut 19' screwed to the shaft 15. At the free external end of the tube member 18 is fixed a head flange 38. At the free end of the shaft 15 is constrained with any appropriate means to a head joint 55 for its connection to a piece of equipment—not shown—which to transmit an operating torque to.

On the other side, between the head flange 38 and the coupling 35 of the supporting unit 19 there can be positioned some thrust springs 39 selected and operating so as to ensure the physical contact of the two coaxial components—tube member/coupling—in the longitudinal support zone, dominating both the load due to possible unbalance of the turbine and the one due to the thrust of the work fluid.

The abovementioned sealing system 40 is preferably the mechanical type and arranged between the internal end of the coupling 35 and the head 15' of the turbine shaft 15 so as also to be extractable together with the other components of the supporting unit 19. Between the coupling 35 of the supporting unit 19 and the tube member 18 can be interposed at least a sealing gasket 18' in the same way as another sealing gasket 36' can be interposed between the mechanical sealing device 40 and the turbine shaft 15. At the front, at the internal end of the tube member 18 is on the other hand assembled a sealing gasket 41 facing towards the head 15' of the turbine shaft 15.

Figure 2:
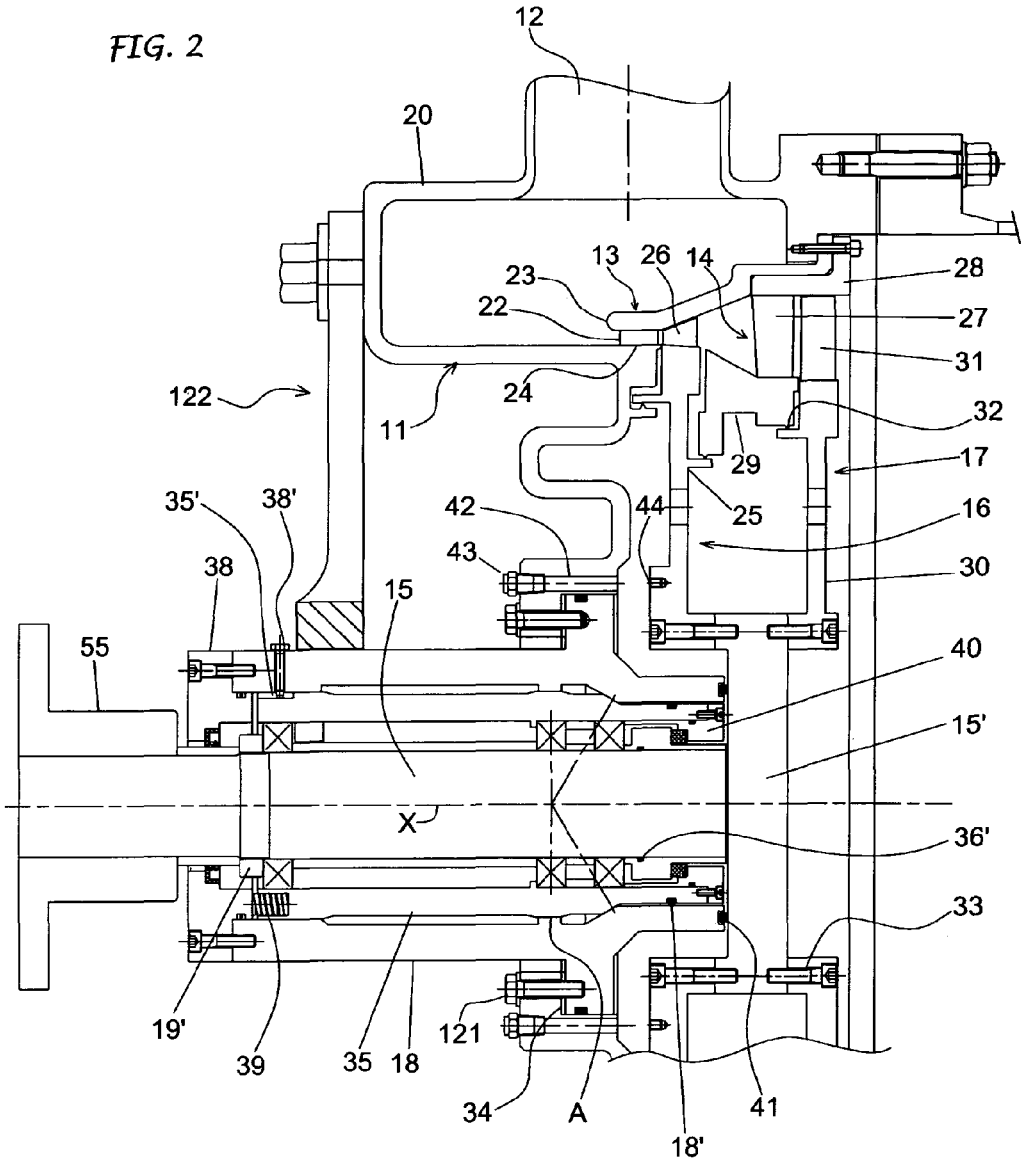
FIG. 2 shows, in a cross sectional view, an assembled part of the turbine.
Figure 3:
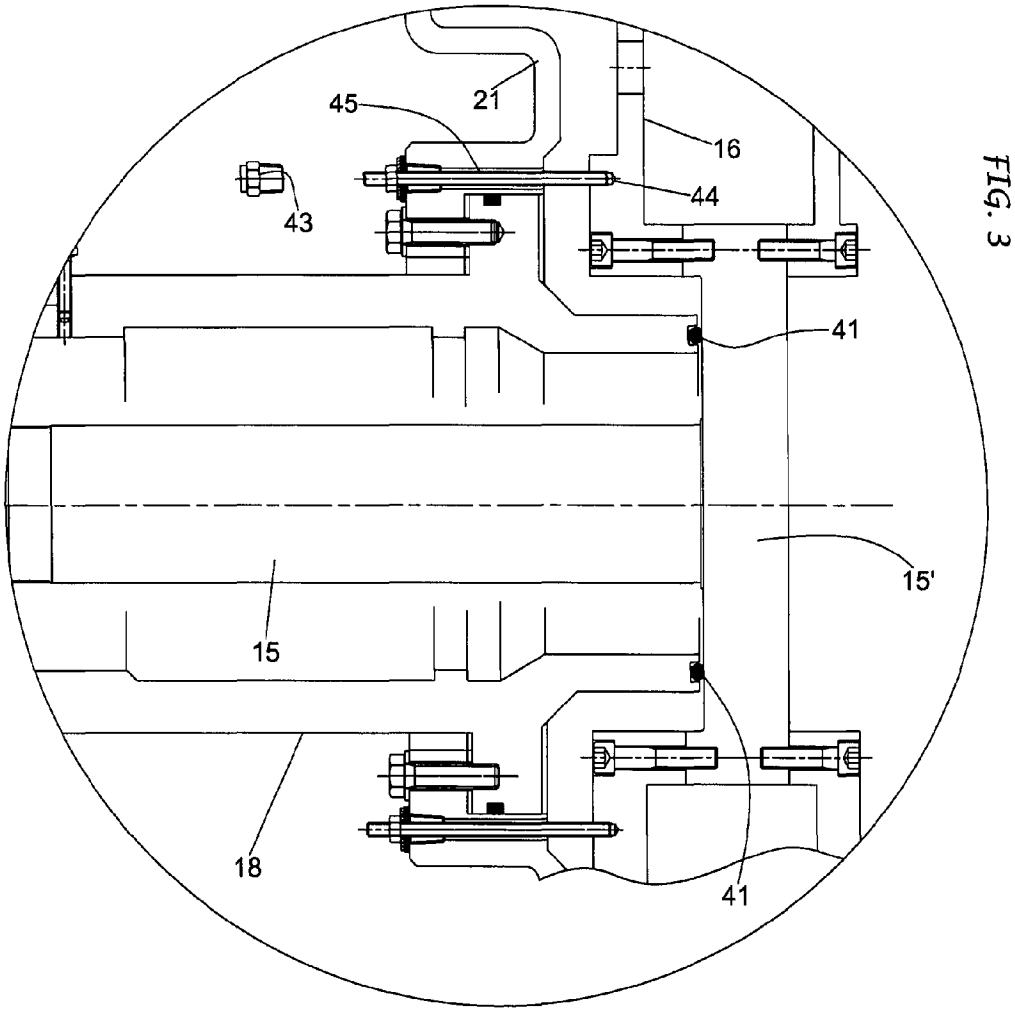
FIG. 3 shows an enlarged view of the circle detail in FIG. 1.

Furthermore, the housed tube member 18 and the coupling 35 are radially engaged between them by a screw or key 38' so as to define the insertion position and prevent the rotation of the coupling in the tube member. As shown in FIG. 2 the screw or key 18' operates in an extended seat 35' so as to allow small axial movements of the supporting unit 19 in regard to the shaft 15 and the tube member 18.

Thanks to this device, the supporting unit 19, thrust by the springs 39, can normally keep itself in an advanced contact position on a level with the longitudinal support zone, but it ca n also retract slightly depending on the axial position of the head of the turbine shaft.

In particular, when the turbine is in operation status, the head 15' of the turbine shaft 15 must remain slightly separate from the internal end of the external tube member 18 that holds the sealing gasket 41. However, at the moment of extracting the supporting unit 19 from the external tube member 18, it is advantageous, as said above, that the head 15' of the turbine shaft 15 can be brought vey near to the end of said tube member 18 to rest against a sealing gasket 41 and to isolate in this way the inside of the turbine from the outside. For this movement, according to the invention, the shield 21, or however a frontal wall of the body or casing of the turbine 11, is provided with—FIG. 2—bores 42 oriented towards the first rotor 16, bores that normally remain closed by plugs 43. When, on the other hand, it is necessary, the plugs can be removed and in this way the bores 42 can each receive a screw 45 which is tightened in a facing hole 44 provided in the disc of the adjacent rotor 16. In this way, it is possible to move the rotoric group towards the internal end of the tube member and by this means the turbine shaft can move to rest its head 15' on the sealing gasket 41. By this movement the head of the turbine shaft obtains a confinement of the fluid of the body or casing of the turbine to avoid unnecessary dispersion, and at the same time a backward movement also of the supporting unit 19 to be able to remove it more easily from the tube member, in particular when the complete full extraction is planned.

The description given above and the drawing that accompanies it refer to a realization of a turbine in which the head 15' of the shaft 15 that carries the rotoric group has a larger diameter than that of the internal end of the external tube member 18. This does not however mean that the confinement system of the fluid in the covering of the turbine previously illustrated cannot be applied also in realization forms in which, although not shown, the head of the shaft supporting the rotoric group has a smaller diameter than that of the internal end of said tube member. In this case, when the rotoric group is in the retracted position the seal 41 at the end of the internal tube member will rest against and seal with a facing part of the disc 25 of the first rotor 16.

The invention claimed is:

1. A turbine for the expansion of gas and vapor, comprising:

a body or casing with a volute for the transit of the fluid from an input to an output passage through at least a statoric and a rotoric group;

a front shield that extends radially from said volute towards an axis of a turbine shaft, an external tube member fixed in front of said shield or said volute designed to hold the turbine shaft with the interposition of a supporting unit, said turbine shaft having a head supporting the rotoric group, wherein the turbine shaft together with the rotoric group is movable axially between a work position, in which the head of said shaft is at a distance from an internal end of the external tube member facing towards the statoric group, and a retracted position, in which the head of the shaft or a part of the rotoric group rests against said internal end of said tube member with the interposition of at least a front seal.

2. A turbine according to claim 1, wherein a means is provided between the body or casing and the rotoric group operating in said body or casing for the movements of the turbine shaft from the work position towards the retracted position.

3. A turbine according to claim 2, wherein said seal is inserted in said internal end of the external tube member and the head of the turbine shaft has a surface that rests against said seal when said shaft is in the retracted position.

4. A turbine according to claim 2, wherein said seal is inserted in said internal end of the external tube member and the rotoric group supported by the turbine shaft has a front surface that rests against said seal when said shaft is in the retracted position.

5. A turbine according to claim 2, wherein said means for the movements of the turbine shaft are placed between a front wall of the body or casing and a part facing the rotoric group.

6. A turbine according to claim 5, wherein said means comprises first bores passing through the shield or a front part of the body or casing of the turbine and facing towards a disk of a first rotor of the rotoric group, second bores provided in said disk of the first rotor lined up with said first bores, and screws passing in said first bores and which are screwed into said second bores to move the turbine shaft towards the internal end of the external tube member.

7. A turbine according to claim 5, wherein, in absence of screws, said first bores, can each be blocked by a plug.

8. A turbine according to claim 1, wherein said seal is inserted in said internal end of the external tube member and the head of the turbine shaft has a surface that rests against said seal when said shaft is in the retracted position.

9. A turbine according to claim 1, wherein said seal is inserted in said internal end of the external tube member and the rotoric group supported by the turbine shaft has a front surface that rests against said seal when said shaft is in the retracted position.

10. A turbine according to claim 1, wherein the supporting unit is housed and centered in the external tube member and is held placed towards the head of the shaft, but not in contact with said head of the shaft, when said shaft is in the forward position.

11. A turbine according to claim 10, wherein said supporting unit rests against the head of the turbine shaft by front sealing means when said support is in the retracted position.

12. A turbine according to claim 10, wherein the supporting unit comprises an internal coupling concentric to the turbine shaft and carrying inside said internal coupling some bearings and sealing means operating on said shaft, wherein said supporting unit is conjugated concentrically and held axially in said external tube member with the possibility of being extracted en bloc.

* * * * *